US005479989A

United States Patent [19]

Shy et al.

[11] Patent Number: 5,479,989

[45] Date of Patent: Jan. 2, 1996

[54] SLEEVE VALVE FLOW CONTROL DEVICE WITH LOCATOR SHIFTER

[75] Inventors: Perry C. Shy, Southlake; Robert W. Crow, Irving, both of Tex.

[73] Assignee: Halliburton Company, Houston, Tex.

[21] Appl. No.: 274,175

[22] Filed: Jul. 12, 1994

[51] Int. Cl.[6] ..... E21B 34/12

[52] U.S. Cl. ..... 166/332.4; 166/334.1

[58] Field of Search ..... 166/373, 384, 166/386, 332, 334

[56] References Cited

U.S. PATENT DOCUMENTS

| | | | |
|---|---|---|---|
| 3,051,243 | 8/1962 | Grimmer et al. | 166/224 |
| 3,802,505 | 4/1974 | Majors | 166/216 X |
| 4,280,561 | 7/1981 | Fredd | 166/332 |
| 4,429,747 | 2/1984 | Williamson, Jr. | 166/321 |
| 4,436,152 | 3/1984 | Fisher, Jr. et al. | 166/214 |
| 4,494,608 | 1/1985 | Williams et al. | 166/317 |
| 4,834,176 | 3/1989 | Renfroe, Jr. | 166/142 |
| 4,850,432 | 7/1989 | Porter et al. | 166/373 |
| 4,896,721 | 1/1990 | Welch | 166/214 |
| 4,941,535 | 7/1990 | Proter et al. | 166/373 X |
| 4,986,362 | 1/1991 | Pleasants | 166/382 |
| 5,000,265 | 3/1991 | Pleasants et al. | 166/387 |
| 5,007,479 | 4/1991 | Pleasants et al. | 166/178 |
| 5,012,871 | 5/1991 | Pleasants et al. | 166/386 |
| 5,040,598 | 8/1991 | Pleasants | 166/98 |
| 5,090,481 | 2/1992 | Pleasants et al. | 166/373 |
| 5,146,984 | 9/1992 | Pleasants | 166/238 |
| 5,146,994 | 9/1992 | Pleasants et al. | 166/387 |
| 5,309,988 | 5/1994 | Shy et al. | 166/237 X |
| 5,355,953 | 10/1994 | Shy et al. | 166/373 X |

*Primary Examiner*—Roger J. Schoeppel

*Attorney, Agent, or Firm*—William M. Imwalle; Shawn Hunter

[57] ABSTRACT

A sleeve valve assembly featuring a cylindrical housing within which a sleeve valve is axially slidable within a radially expanded section of the housing. The radially expanded section of the housing presents an inwardly extending stop shoulder at one point along its length and an annular expansion notch at another point. The sleeve valve includes a radially projecting chamfered boss about its circumference. A portion of the sleeve valve is longitudinally slotted so as to form collets. An outwardly biased C-ring is disposed about the sleeve valve within the radially expanded section. The C-ring is initially disposed to be free to travel axially along the radially expanded section between the boss and the stop shoulder. As the sleeve valve is moved toward an open position, the boss, C-ring and stop shoulder engage each other such that the sleeve valve is releasably snagged against further axial movement toward the open position. A significant axial force upon the sleeve valve is required to effect unsnagging. Upon application of increased axial force, the collets of the sliding sleeve are forced radially inward to permit the boss to slip past the C-ring.

An exemplary stimulation tool incorporating the sleeve valve assembly is described which permits acid to be selectively communicated into the surrounding formation. A stimulation tool constructed in accordance with the present invention is particularly useful for acid stimulation applications in horizontal well conduits as the snagging feature of the sleeve valve assembly provides a positive indication that lateral acid flow ports within the shifter tool have been placed adjacent complimentary flow ports in the surrounding housing.

6 Claims, 10 Drawing Sheets

SLEEVE VALVE FLOW CONTROL DEVICE WITH LOCATOR SHIFTER

BACKGROUND OF THE INVENTION

1. Field of the Invention

The present invention relates generally to a flow control device having a sleeve valve arrangement operable by means of a shifter tool. The invention has particular application for acidizing stimulation tools used in horizontal or other deviated wells.

2. Description of Related Art

Acidizing is a popular method of well stimulation in which the porosity and/or permeability of the reservoir is increased by pumping acid into portions of a formation adjacent to a well bore. In some wells, more than one zone will have been perforated or exposed by an open hole completion. Because the zones will often have different permeabilities, acid would tend to enter the zone with the highest permeability first. However, this zone would be the one least needing acid. A number of mechanical methods are known for selective placement of acid such that the majority of acid is placed into the lower-permeability zones. These methods include the use of ball sealers which are dropped into the well to block the perforations along a zone. In addition, packing elements and plugs may be used as seals to separate zones in a formation. Unfortunately, such elastomeric members may be unreliable, particularly at great well depths where portions of the tubing string may be maintained at temperatures at or above 200° F. Ambient temperature acid pumped down into the well will cause the metallic elements of the tubing string to contract when the acid reaches these depths. As continued pumping of acid causes the formation to deteriorate and the rate of acid flow to increase, the contraction can be significant and cause loss of elastomeric seals with the seal bores.

A sleeve valve or sliding side door arrangement is an effective alternative to a elastomeric seal. Use of sleeve valves for selectively opening or closing a port is well known in the art of well drilling. Shifter tool arrangements that operate the sleeve valves are known which engage compatible profiled grooving in a well conduit. Such arrangements selectively locate and lock a shifter tool into compatible profiled grooving in a well conduit using upper and lower expander surfaces provided on an inner mandrel and which are moveable downwardly inside a set of keys for locking the keys in an expanded and engaged position. This action connects the shifter tool and the profiled grooving together until disconnect is desired. The shifter tool may be operated to retract the keys when required for disconnect from the profiled grooving by use of a hydraulic jar or methods such as the shearing of a shear pin or use of a ratchet type indexing system.

While arrangements such as these are useful for securing a shifter tool at a selected location within a well conduit, they have problems related to the release of the shifter tool from the conduit. Shear pin arrangements cannot be reset or reused without withdrawing the tool from the conduit to replace the shear pins. Jar and ratchet techniques involve significant manipulation of the tubing string from the surface and are time consuming.

Deviated wells, particularly horizontal wells, magnify operational problems associated with tool operation. These problems are significant for acid stimulation tools which incorporate sleeve valve arrangements due to the caustic, corrosive nature of acid. First, it is difficult to hydraulically balance the mud in a horizontal well. In a vertical well, mud provides a head to balance the downhole pressure from the well. In a horizontal well, however, there is no fluid head to balance the downhole pressure. If acid has been improperly placed within the well, such as into a portion with no access to the formation perforations, the acid may flow back out of the well. When shifter tools are removed from a horizontal or deviated well, the tools tend to swab out the mud along with any residual acid. Because the production zone may be 5000 feet or so out into a horizontal borehole, it is important that the operator know exactly the location of the stimulation tool within the tubing string.

Also, gravity disposed wireline devices cannot be used in these wells. Coiled tubing must be used to place the shifter tool properly for operation of the sleeve valves. Coiled tubing, however, will not structurally support the application of great compressive forces which are often used to "locate" the shifter arrangement within the housing such that acid may be safely flowed into surrounding perforations. The tubing can, however, support much greater loads in tension than in compression.

Horizontal wellbore location systems are known which employ an inner locator tool which is disposed within a ported housing. The tool is located within the housing under compression. As noted, however, compressive limitations exist for coiled tubing. It is difficult to accurately locate the stimulation tools such that the acid flow ports are located within the desired stimulation zone due to the tendency of the tool's components to "stack-up" as they are pushed into the wellbore. Because of the problems of hydraulically balancing horizontal wells. improperly placed acid may flow back out of a horizontal wellhead or be backwashed out when the tool is withdrawn. Therefore, it is desirable to develop a system for acidizing formations which avoids the problems of lost wellbore seals and permits more reliable location of stimulation tools within horizontal wellbores.

SUMMARY OF THE INVENTION

An exemplary stimulation tool is described which includes an internal shifter string and a surrounding tubing string which is disposable within a cased borehole. The tubing string is made up of a number of housing sections which include sleeve valve assemblies. The shifter string incorporates at least one shifter tool with one or more shifters. Among the shifters are an opening shifter, closing shifter and a locating assembly which is positioned on the shifter tool in concert with associated acid injection ports such that the locating assembly will enter a snagging engagement with a housing section at a point where the acid injection ports become generally aligned with acid flow ports in the surrounding housing. The shifter tool will become effectively snagged into a position within the tubing string wherein acid may be communicated through the tubing string and borehole casing into the surrounding formation. The shifter tool may then be unsnagged and moved to a new position in the tubing string where acidizing may be undertaken in a similar manner. The shifter tool may be moved between several downhole locations or producing zones to be stimulated without pulling the tool from the tubing string as would be required by other arrangements such as those employing shear pins. A stimulation tool constructed in accordance with the present invention is particularly useful for acid stimulation applications in horizontal well conduits.

The sleeve valve assemblies feature a sleeve valve which is axially slidable within a radially expanded section of its surrounding housing. The sleeve valve is operable between an open position, wherein an associated port in the housing is open to communicate fluid, and a closed position, wherein the port is closed against fluid communication. The radially expanded section of the housing presents an inwardly extending stop shoulder at one point along its length and an annular expansion notch at another point. A portion of the sleeve valve is longitudinally slotted so as to form collets and having a radially projecting chamfered boss. An inwardly biased C-ring is disposed about the sleeve valve within the radially expanded section. The C-ring is initially disposed to be free to travel axially along the radially expanded section between the boss and the stop shoulder.

As the sleeve valve is moved toward its open position, the boss, C-ring and stop shoulder engage each other such that the sleeve valve is snagged against further axial movement toward the open position. A significant axial force upon the sleeve valve is required to slip the boss past the C-ring and effect disengagement and unsnagging. If it is desirable to unsnag the locating assembly, upon application of increased axial force, the collets of the sliding sleeve may be forced radially inward to permit the boss to slip past the C-ring.

The locating assembly engages the open sleeve valve and maintains it in the open position at a point where the acid injection port is located adjacent the port in the housing. As the sleeve valve reaches a position where the boss, C-ring and stop shoulder engage, the shifter tool becomes secured in snagging engagement with the housing such that an increased amount of axial force must be applied to the shifter tool to axially unsnag it from the housing. The axial force is preferably applied in tension. The axial force required to unsnag the shifter tool is typically much greater than the amount of force required to move the tool within the housing unsnagged. The sharply increased resistance to axial movement induced by the snagging engagement "locates" the shifter tool within the housing and functions as a signal to tool operators that the shifter tool is properly located.

A closing shifter below the locating assembly may be used to move the sleeve valve into a closed position. Movement of the sleeve valve toward its closed position may be accomplished without creating a snagging condition for the sleeve valve. The C-ring is moved by the boss within the expanded section toward and ultimately into the radial expansion notch wherein it is permitted to expand to permit the boss to travel past the expansion notch.

DETAILED DESCRIPTION OF THE PREFERRED EMBODIMENTS

Figure 1A:
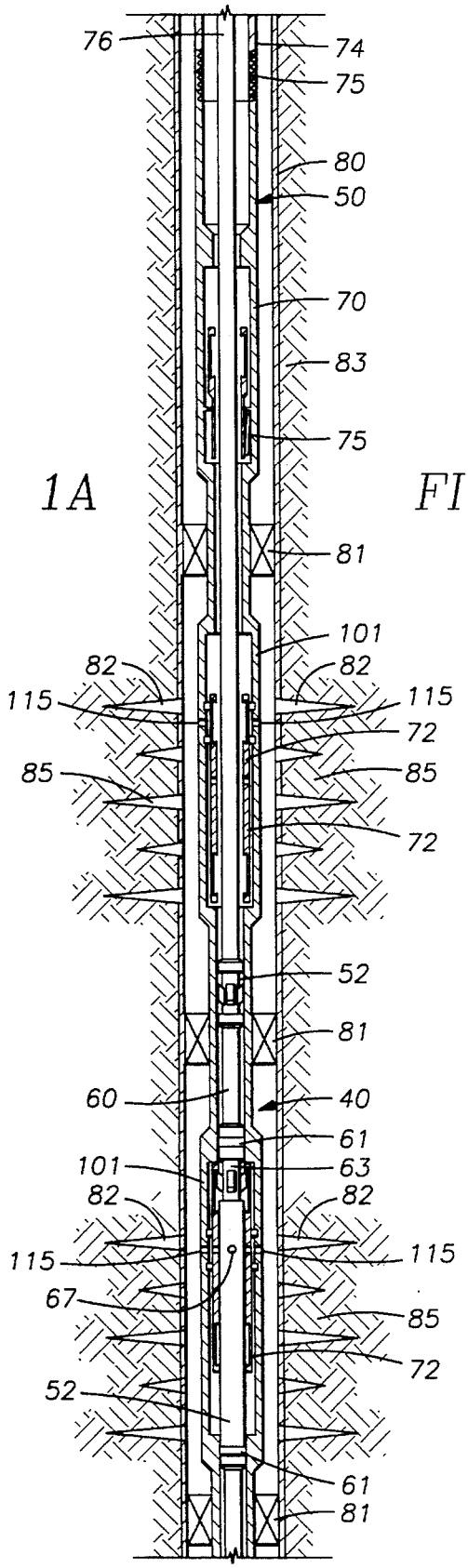
FIGS. 1A and 1B show an exemplary stimulation tool incorporating sliding sleeve assemblies disposed within a cased borehole 80.
Figure 1B:
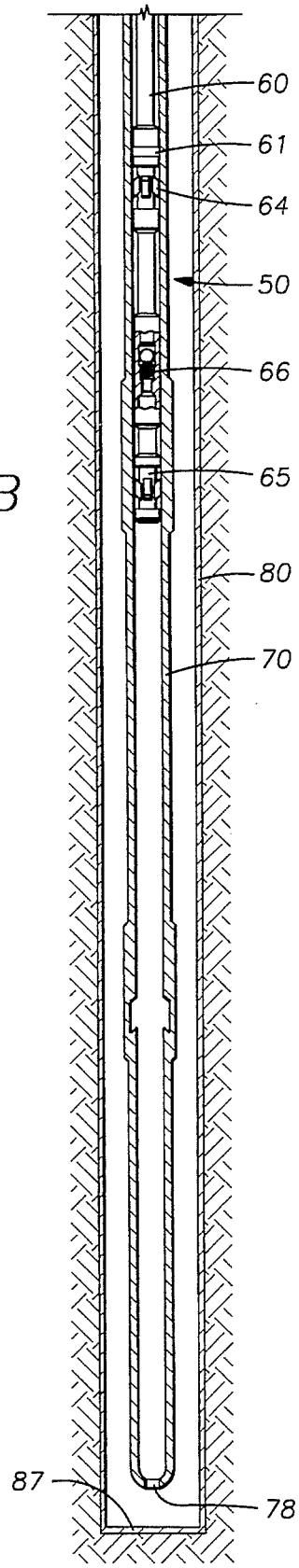

Referring first to FIGS. 1A and 1B, a stimulation tool 40 is featured which includes an tubing string 70 and an shifter string 76 suspended within a cased borehole 80. Cased borehole 80 extends through one or more hydrocarbon producing zones 85 in the surrounding formation 83. The borehole 80 is preferably a horizontal well, although it may be any type of well including a breaker well or deviated well. The term "upper" as used herein shall mean in relation to the bottom 87 of borehole 80 even though borehole 80 may be horizontal. The shifter string 76 is typically made up of sections of wash pipe or coiled tubing. Cased borehole 80 has been perforated by perforations 82 to allow the hydrocarbons to flow from the producing zones 85 into the cased borehole 80.

Due to the features described herein, the stimulation tool 40 is operable to selectively inject a stimulation fluid; such as acid from the surface via acidizing mandrel 52 through perforations 82 and into producing zones 85. The shifter string 76 is connectable within a well flow conductor (not shown) through which fluids such as acid are flowed. The tubing string 70 preferably is adapted internally with surface engagement means 75, such as threads or notches, to engage generally complimentary engagement means on a string of pipe 74 which extends to the surface of the well. The stimulation tool 40 also includes a hinged flapper valve 75 to assist in sealing off the tubing string 70 after the shifter string 76 and shifter tool 60 are removed. An aperture 78 is provided at or near the bottom end of the tubing string 70 for the passage of well fluids as shifter string 76 is slidably disposed within tubing string 70. Velocity check valve 66 is disposed above well control valve shifter 65.

In operation, the tubing string 70 is disposed within the cased borehole 80 such that the sleeve valve assemblies 72 are located proximate perforated producing zones 85. Often, more than one sleeve valve assembly 72 will be located proximate each set of perforations 82 in case one assembly becomes non-functional. Packers 81 are placed on each side of the producing zones 85 to isolate and insulate the producing zones 85 during stimulation.

The shifter tool 60 is then assembled within the tubing string 70 and axially moveable therewithin. Aperture 78 vents well fluids to prevent a hydraulic lock up of shifter string 76 as string 76 is moved within tubing string 70. The shifters along the length of the shifter tool 60 include opening shifter 62, locating assembly 63, closing shifter 64, and well control valve shifter 65. The sleeve valve assemblies 72 along the length of tubing string 70 contain a number of ports 115. As noted, the ports 115 are preferably located proximate perforations 82 and are adapted to permit fluid communication between the interior of the tubing string 70 and the exterior thereof. As will be described in further detail below, the ports 115 are actuatable by sleeve valve assemblies 72 and shifters 62, 64.

Figure 2A:
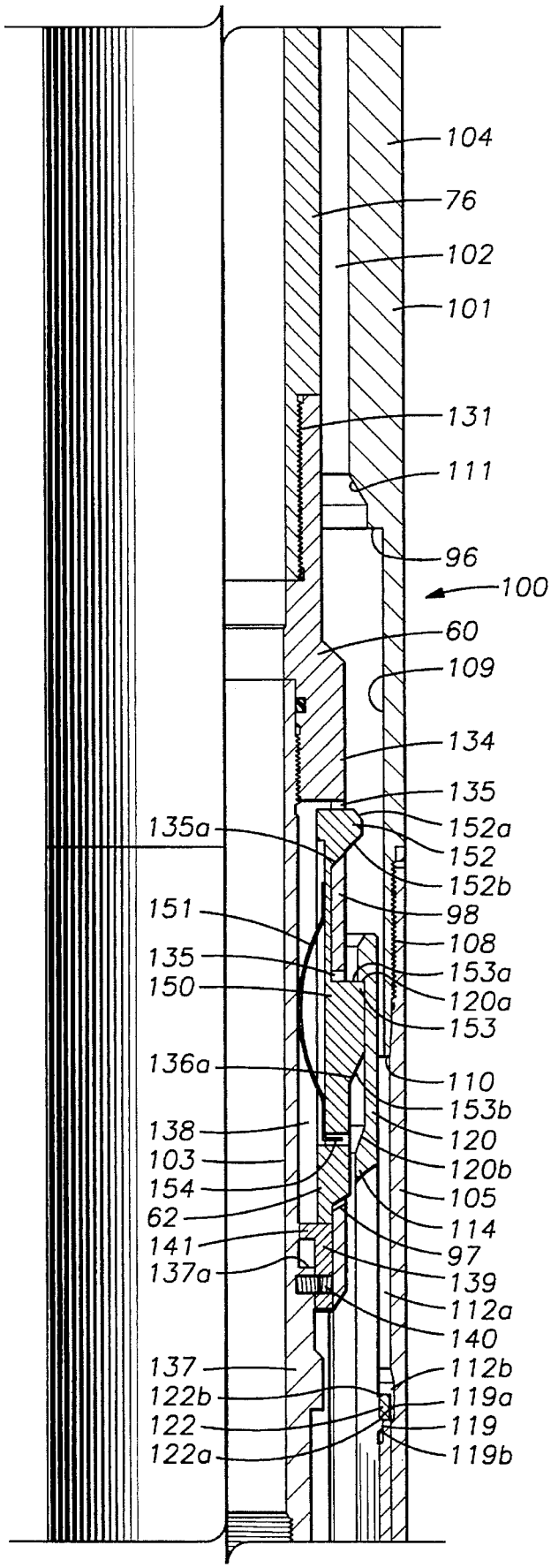
FIGS. 2A and 2B illustrate an exemplary sleeve valve assembly wherein an opening shifter is engaging a sleeve valve in its closed position.
Figure 2B:
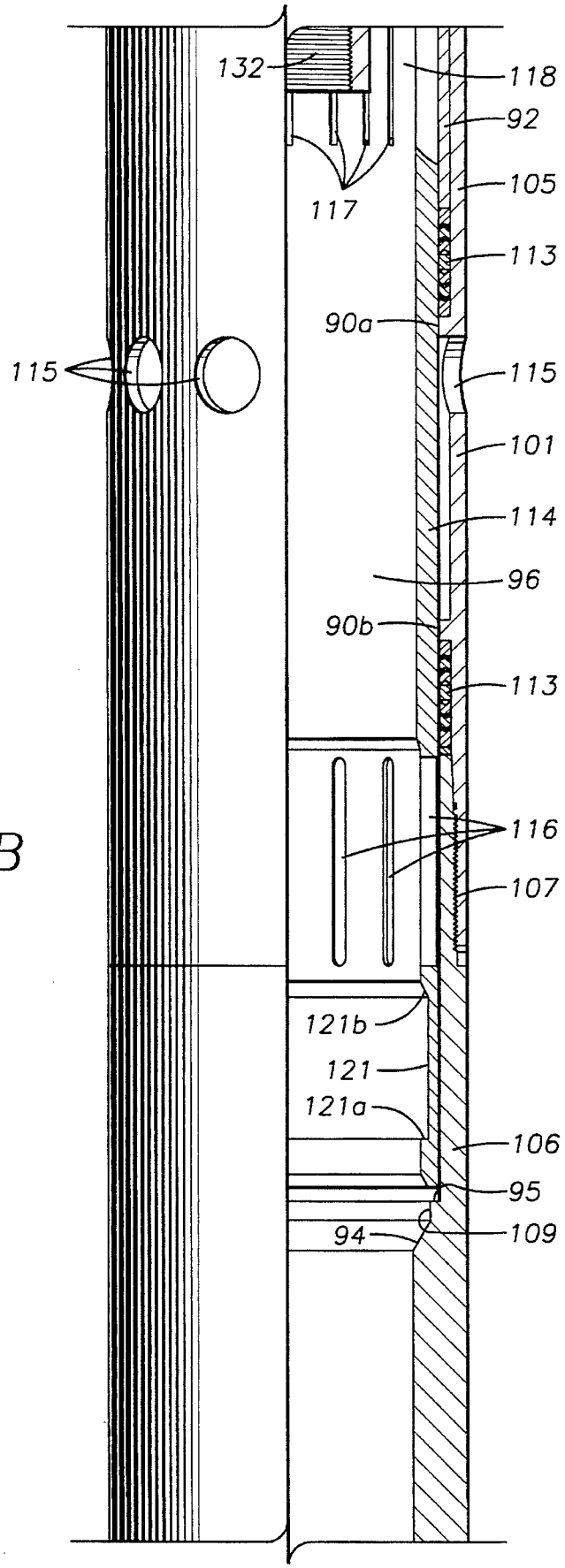
Figure 3:
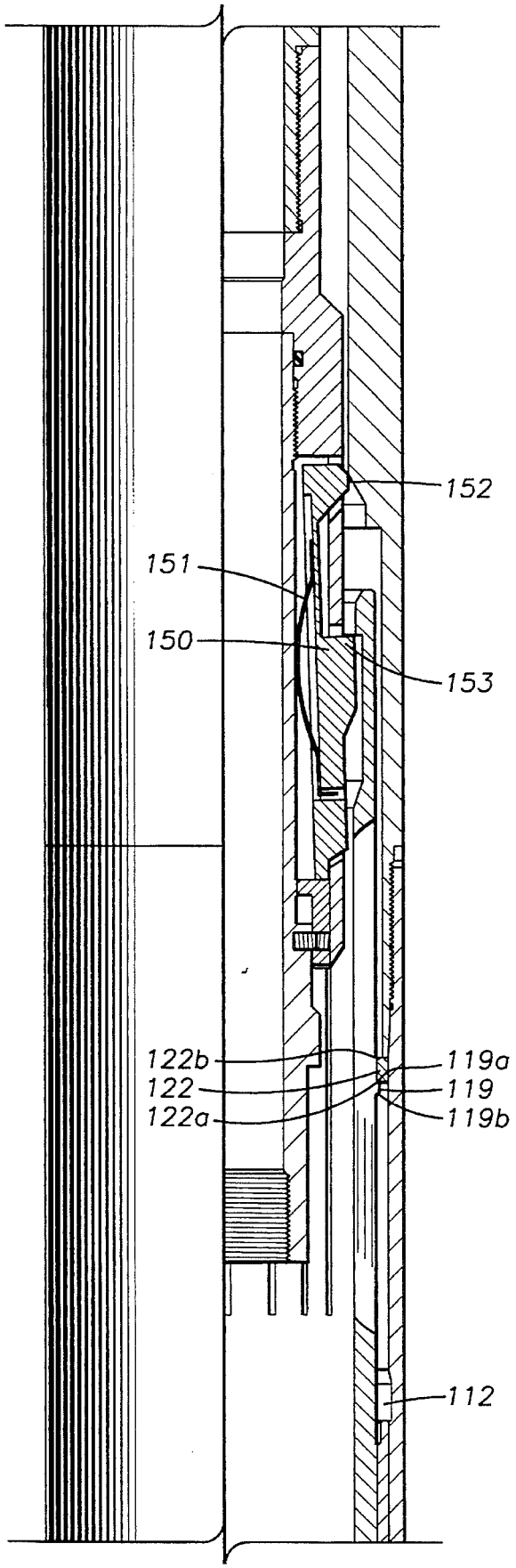
FIG. 3 illustrates the sleeve valve assembly of FIG. 1 in an open position with the opening shifter disengaging from the sleeve valve.

The tubing string 70 includes sections of housing 101 (shown in FIG. 2). The shifter string 76 includes one or more shifter tools 60 along its length and a velocity check valve 66 near the lower end. A section of housing 101 and shifter tool 60 collectively constitutes a flow control device 50, which can selectively place fluids disposed through the well flow conductor and into producing zones 85 as desired. To control selective placement, the flow control device 50 incorporates one or more sleeve valve assemblies 72 whose function and operation will be described shortly. Exemplary shifter tool 60 includes a plurality of shifters 62, 63, 64 and 65, an acidizing mandrel 52 with annular seals 61 on each side thereof.

Referring now to FIGS. 2–7, an exemplary sleeve valve assembly 100 of the plurality of sleeve valve assemblies 72 is shown in greater detail. The sleeve valve assembly 100 includes a generally cylindrical outer housing 101 which is serially connected and made a part of tubing string 70 and includes an interior fluid flow conduit 102 formed by the interior cylindrical surface 103 of housing 101. The housing 101 is formed of an upper sub 104, a nipple or intermediate sub 105, and a lower sub 106. The intermediate and lower subs 105 and 106 are attached by a threaded connection 107. Similarly, upper sub 104 and intermediate sub 105 are connected by means of a threaded connection 108. The housing 101 includes an enlarged diameter, radially expanded internal section 109 disposed in subs 104, 105 and 106. At the lower end of the threaded connection 108, the pin nose of the upper sub 104 presents an annular stop shoulder 110. An annular releasing profile 111 which slopes or curves radially inward to form a downwardly facing frusto-conical shoulder is located above expanded internal section 109. Below the stop shoulder 110, the intermediate sub 105 includes an enlarged diameter bore 112*a*. At the lower end of the enlarged diameter bore 112*a*, intermediate sub 105 features an enlarged annular expansion recess or notch 112*b* about a portion of its internal circumference.

Sub 105 further includes upper and lower inwardly projecting annular radial bearing surfaces 90*a*, 90*b*. Bearing surfaces 90*a* and 90*b* each form an annular shoulder adjacent to which is disposed a packing ring assembly 113. Packing ring assembly 113 includes a plurality of chevron resilient seals with end retainer rings. An actuator sleeve 92 is disposed within expanded internal section 109 between expansion notch 112*b* and upper sealing assembly 113. The lower sealing assembly 113 is actuated by the pin nose of lower sub 106 upon the threaded engagement of thread connection 107. A plurality of ports 115 are azimuthally spaced around the circumference of housing 101 between upper and lower bearing surfaces 90*a* and 90*b*. Lower sub 106 also includes an upwardly facing frusto-conical actuating shoulder 94.

The sleeve valve assembly 100 further includes a closing sleeve or sleeve valve 114 which is axially slidably received within the radially expanded section 109 to be shifted up or down to open or close flow ports 115. Sleeve valve 114 forms a common flow bore 96 with shifter string 76. Ports 115 within the housing 101 are adapted to permit fluid communication from the interior to the exterior of the housing 101. A number of longitudinally extending apertures 116 are formed about the circumference of the sleeve valve 114 which, when aligned with ports 115, permit fluid flow from the interior fluid flow conduit 96 of shifter string 76 and through ports 115 in the housing 101. Sleeve valve 114 also includes a plurality of longitudinally extending slots 117 which define collets 118. In one exemplary preferred embodiment, the slots are 1/10" in width and spaced azimuthally from each other about the circumference of the sleeve valve 114 at 22½° intervals. Each collet 118 includes a radially projecting member or boss 119 which projects outward from the collet 118 and into the radially expanded section 109. Preferably, the boss 119 presents an upwardly facing frusto-conical surface 119*a* and a downwardly facing frusto-conical surface 119*b*. Surfaces 119*a* and *b* are chamfered or angled at about a 45° angle. In one exemplary embodiment, the boss measures ⅜ inch in height. The sleeve valve 114 includes upper and lower interior engagement recesses 120 and 121. The upper engagement recess 120 presents an annular downwardly facing upper force bearing shoulder 120*a* and a lower upwardly facing, inward camming frusto-conical surface 120*b*. The lower engagement recess 121 presents a lower annular upwardly facing, force bearing shoulder 121*a* and an upper downwardly facing, inward camming frusto-conical surface 121*b*.

The outer cylindrical surface of sleeve valve 114 slidingly engages that portion of section 109 disposed in lower sub 106. The outer surface of sleeve valve 114 also bears against annular bearing surfaces 90*a* and 90*b* in intermediate sub 105. Actuator sleeve 92 is disposed between the outer cylindrical surface of sleeve valve 114 and the inner cylindrical surface of section 109. Sleeve valve 114 has a length which is smaller than the length of section 109, allowing sleeve valve 114 to be axially slidable within expanded section 109 between the lower annular shoulder 95 formed in lower sub 106 of expanded section 109 and the downwardly facing annular shoulder 96 of upper sub 104 forming the upper end of expanded section 109.

A split ring or C-ring 122 is slidingly disposed in the annulus formed by the outside of the sleeve valve 114 and the inner circumference of expanded section 109 of intermediate sub 105. In cross section, the C-ring 122 features radially interior comers 122*a* and 122*b* which are chamfered or otherwise reduced to be angled at approximate 45° angles. This feature is best appreciated by reference to FIG. 7. C-ring 122 is placed such that it can travel axially along the enlarged diameter bore 112*a* between the inwardly extending stop shoulder 110 and the expansion notch 112*b*. The C-ring 122 is sized such that it will be closely received within the enlarged diameter bore 112*a*, such that C-ring 122 is contracted and thereby reduced in diameter. It should also be sized so that it will be more loosely received within radial expansion notch 112*b* and the C-ring 122 allowed to expand and thus be enlarged in diameter. The C-ring is located initially proximate the stop shoulder 110. The C-ring 122 is preferably biased such that it can expand radially of its own accord.

An exemplary opening shifter 62, illustrated in FIGS. 2A–B and 3A–B, includes appropriate upper and lower connections 131, 132 for operably connecting the opening shifter 62 into the shifter string 76. The opening shifter 62 features an outer key mandrel 134 connected to string 76 at upper connection 131. The outer key mandrel 134 has a body portion with a downwardly extending skirt 98 having a number of key slots 135 and an equal number of key openings or windows 136 azimuthally spaced around the circumference of the skirt 98. The lower end of each key slot 135 is provided with an upwardly facing, inward camming surface 135*a*. The lower end of each window 136 is similarly provided with an upwardly facing inward camming surface 136*a*.

Opening shifter 62 also includes a tool mandrel 137 threadedly engaged at its upper end to the body portion of the outer key mandrel 134. Mandrel 137 has a reduced diameter portion adjacent its upper end presenting an outwardly projecting upwardly facing bearing shoulder 137*a*. When so engaged, the reduced diameter portion forms a key recess 138 between the outer key mandrel 134 and the tool mandrel 137.

A set of radially moveable keys 150 reside within the key recess 138 for radial movement through the key slots 135 and key windows 136. There are preferably four such keys disposed at 90 degree angles from each other about the circumference of tool mandrel 137. The keys 150 are outwardly biased by and resiliently held away from the tool mandrel 137 by means of one or more bow springs 151. Each bow spring 151 includes a lower radially outwardly projecting lower end which is received within a slot in key 150. Key recess 138 has a length that will allow bow spring 151 to contract into a flattened position so as to be totally received within the key recess 138. A spring retaining slot 154 within key 150 is provided to receive a portion of bow spring 151. The keys 150 include an outwardly projecting nose or cam head 152 and an outward projecting square abutment shoulder 153. The cam head 152 presents an upwardly facing frusto-conical camming surface 152*a* and a downwardly facing frusto-conical camming surface 152*b*. The upper camming surface 152*a* is shaped to be complimentary to releasing profile 111. Abutment shoulder 153 presents an upper force bearing shoulder 153*a* and a downwardly facing frusto-conical camming surface 153*b*. Each key recess 138 includes a movable key 150 with the cam head 152 projecting through the key slot 135 and the abutment shoulder 153 projecting through the key window 136. The keys 150 are maintained in key recess 138 by an annular sleeve 139 connected to tool mandrel 137 by a frangible shear pin 140. As there are preferably four keys 150, there are also preferably four shear pins 140. Annular sleeve 139 includes an inwardly projecting annular radial flange 141 bearing against the lower terminal end of keys 150. Annular flange 141 projects within key recess 138. The outer circumferential surface of sleeve 139 provides an annular bearing surface for the lower end of the skirt 98 of outer key mandrel 134.

In operation, the shifter string 76 is moved upwardly within tubing string 70 causing the keys 150 of opening shifter 62 to engage the sleeve valve 114 for the purpose of moving it to the open position. As key window 136 is aligned with the upper engagement recess 120 in sleeve valve 114, bow spring 151 biases key 150 outward through the key window 136 and into recess 120. The upper force bearing shoulder 153*a* of shoulder 153 engages the upper force bearing surface 120*a* on sleeve valve 114. Thus engaged, further upward movement of the opening shifter 62 moves the sleeve valve 114 upwardly within section 109 and into an open position, as shown in FIGS. 3A–3B, wherein apertures 116 are adjacent ports 115 in the housing 101 to permit fluid communication between the flow bore 96 of shifter string 76 and the perforations 82 of producing zone 85. The tension force required to open the sleeve valve 114 should not be significantly greater than that required merely to move the shifter string 76 with respect to the tubing string 70.

Further movement of the opening shifter 62 in the upward direction causes the key head 152 of keys 150 to disengage the abutment shoulder 153 of the sleeve valve 114 while valve 114 remains in the open position. As illustrated in FIG. 3A, the upper camming surface 152*a* of key head 152 contacts and is cammed inwardly by releasing profile 111. This inward camming disengages the upper force bearing surface 153*a* of square abutment shoulder 153 from the upper force bearing surface 120*a* on sleeve valve 114 allowing opening shifter 62 to move out of housing 101 and upwardly into tubing string 70.

Figure 4A:
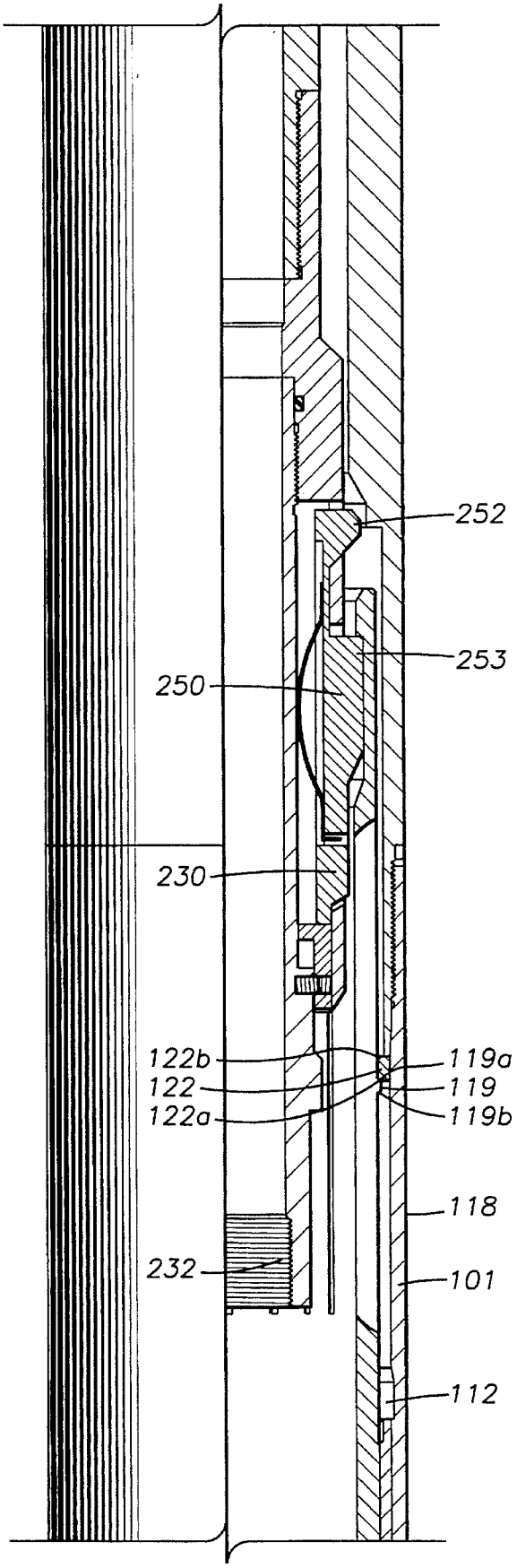
FIGS. 4A and 4B illustrate the sleeve valve assembly of FIG. 1 in a releasably snagged condition with a locator assembly and sleeve valve engaged.
Figure 4B:
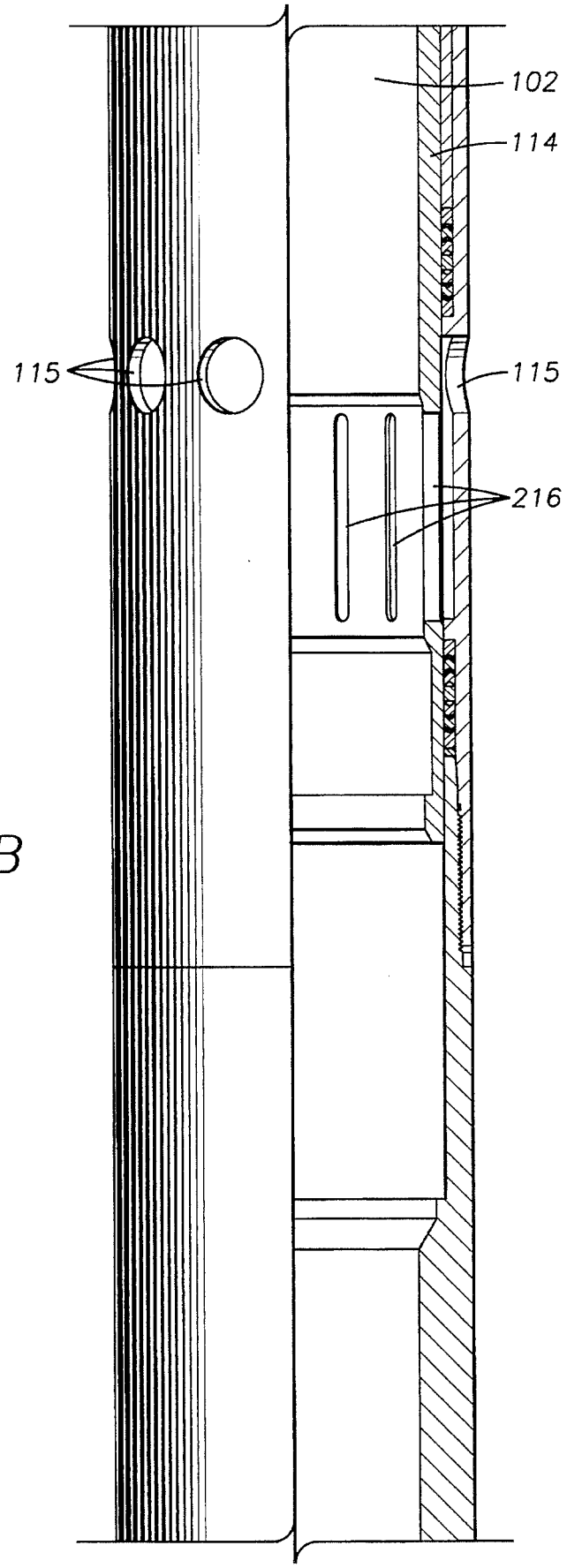
Figure 5:
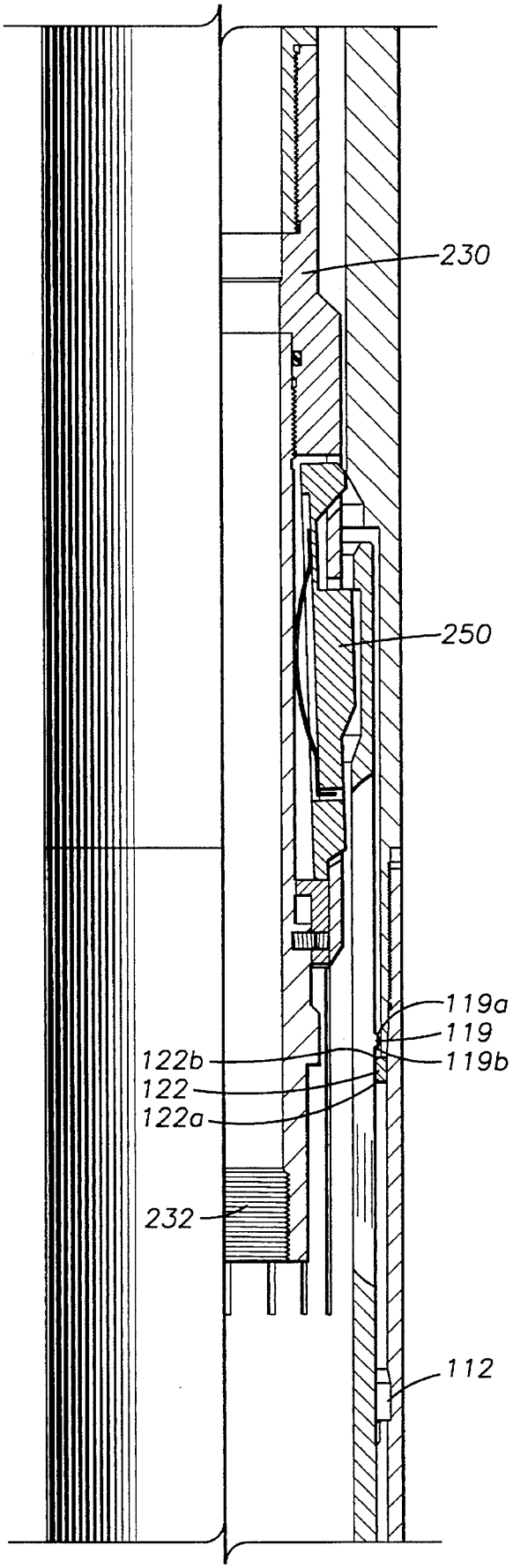
FIG. 5 illustrates the sleeve valve assembly of FIG. 1 after release from snagging.

Once the sleeve valve 114 is open, it is desirable to locate it and pump acid through it. As can be seen by reference to FIGS. 1A and 1B, further upward movement of shifter string 76 causes the locating assembly 63 to pass into the flow bore 102 of housing 101. Referring now to FIGS. 4*a* and 4*b*, there is shown locating assembly 63 which is similar in construction and operation as opening shifter 62. The locating assembly 63 is typically located one pipe section below the opening shifter 62. In conventional tool strings, a section of pipe is typically 30 feet in length. One difference between opening shifter 62 and locating assembly 63 is that the axial distance between the key head 252 and the abutment shoulder 253 on keys 250 of the locating assembly 63 is less than the axial distance between the key head 152 and the abutment shoulder 153 on the keys 150 of the opening shifter 62. The acidizing mandrel 52, shown in FIG. 1A, which contains lateral ports 67 is engaged at lower connection 232. Lateral ports 67, longitudinally extending apertures 116, and ports 115 together form a passageway to perforations 82.

As force is exerted upon the locating assembly 63 to move it upward with respect to housing 101, the reduced axial length causes boss 119 of sleeve valve 114 to encounter C-ring 122 housed within the enlarged diameter bore 112*a*. Corner 122*a* of the C-ring 122 engages surface 119*a* of boss 119. Each collet 118 and boss 119, then may be characterized as a stop member which blocks passage of the locating assembly 63 upwardly past the location of the sleeve valve assembly 100. The sliding sleeve valve 114 and the engaged locating assembly 63 become releasably snagged within the housing 101.

Once snagged, acidizing may occur with acid being flowed into the perforations 82 of the producing zone 85 through the passageway formed by lateral ports 67, longitudinally extending apertures 116, and ports 115.

Figure 7:
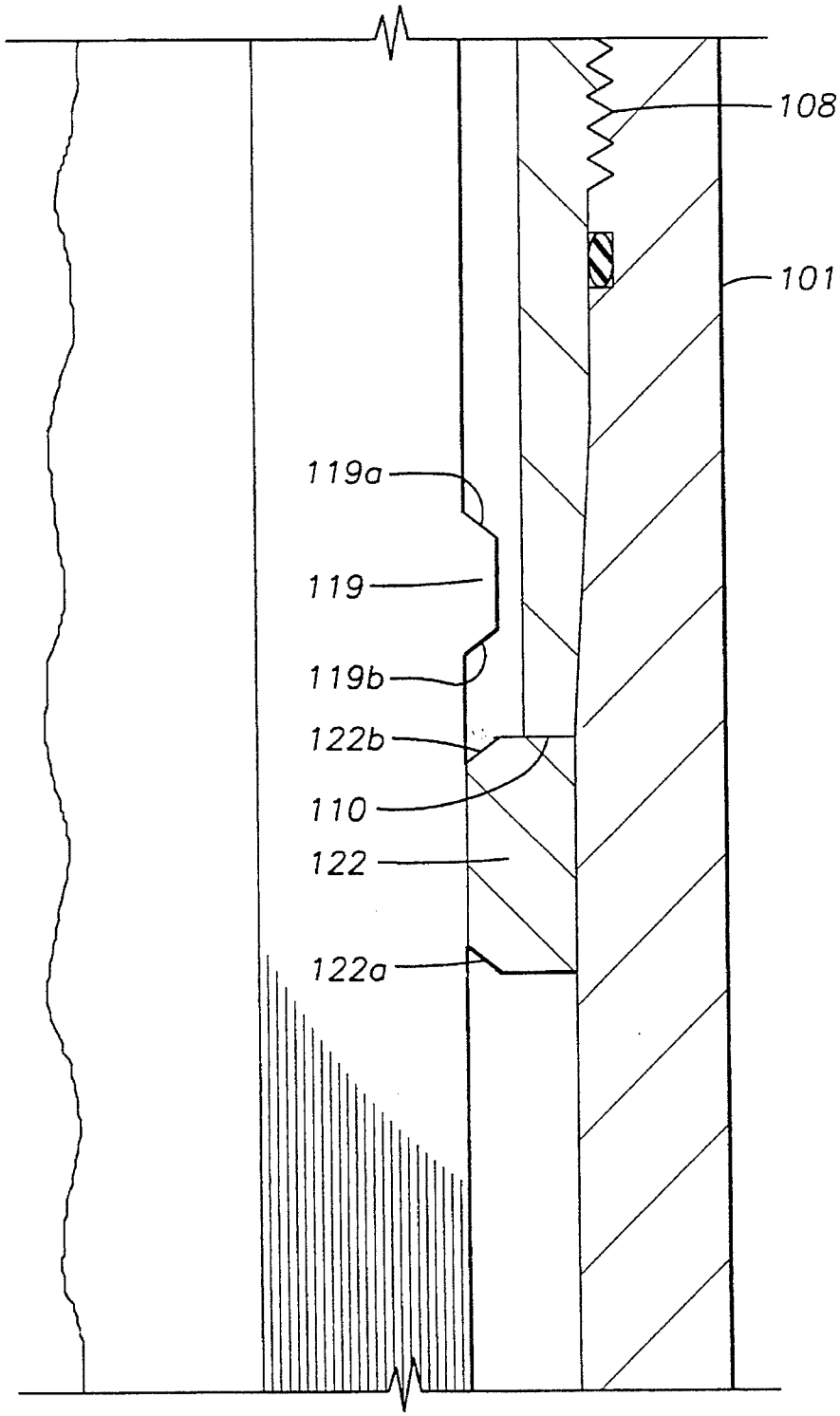
FIG. 7 provides a detail of an exemplary boss and C-ring.

Upon completion of acidizing operations, the locating assembly 63 may be unsnagged by means of increased axial force upon the shifter string 76. As increasing tension force is applied to the shifter string 76 and locating assembly 63, collets 118 are urged radially inwardly to a degree sufficient to overcome the snag by permitting C-ring 122 to pass beneath the boss 119 on each collet 118. A significant amount of tension force will urge the collets 118 radially inward such that boss 119 is able to move past C-ring 122. Chamfering, beveling or other reduction of the complimentary engaging surfaces 122*a* and 119*a* to, for example, 45 degree angles assists the movement of boss 119 past the C-ring 122 by essentially camming the boss 119 radially inward toward a radially contracted position. This chamfering, as shown in FIG. 7, also prevents a rigid locking-type mating of the C-ring 122 and boss 119 which would cause the locator shifter 63 to become permanently stuck. The force needed to move boss 119 past C-ring 122 may be determined by a weight indicator at the surface.

The snag may be overcome by application of a significantly greater amount of tension force upon shifter string 76. To ensure that it is apparent that the shifter tool has become snagged, the tension force needed to overcome the snag is generally at least twice as great as the normal force needed to move the shifter string 76 with respect to the tubing string 70 in an unsnagged condition. In an exemplary embodiment, approximately 2,000 lbs. of force, corresponding in large part to the frictional forces imposed by the sealing elements within the housing, might be needed to move the shifter tool within the housing. However, a tension force of 30,000 or more might be required to unsnag the shifter tool.

The sharply increased resistance to upward movement of the shifter string 76 associated with snagging of the locating assembly 63 on C-ring 122 serves a location function and a signal function. The location function ensures that the lateral flow ports 67 of the acidizing mandrel 52 are located adjacent the ports 116 in the sleeve valve 114 and that the sleeve valve 114 is in its open position so that stimulation fluid may be flowed through the flow bore 96 of shifter string 76 and properly placed into the perforations 82. The apparatus functions as a signal by providing a positive indication to operators at the surface that the sleeve valve 114 is opened and that the acidizing mandrel 52 is properly located. The signal function is valuable in applications such as acidizing operations wherein acid is properly and safely flowed into the flow conductor only after the sleeve valve 114 has been opened and the tool has been properly "located".

Testing has shown that the tension force on shifter string 76 will increase on the order of 25,000 to 35,000 pounds. During acidizing, adequate tension force, typically 15,000–18,000 pounds, should be maintained upon the inner string so that boss 119 is known to be engaged with C-ring 122 and yet not enough tension force should be applied to cause boss 119 to slip past C-ring 122.

The upward tension force on shifter string 76 is maintained throughout the stimulation operation. This provides a constant indication that the acidizing mandrel 52 is located adjacent ports 115 and that seals 61 are sealingly engaged within the seal bores above and below housing 101. As stimulation fluid, such as acid, is passed down shifter string 76, the cooler stimulation fluid causes the shifter string 76 to contract. As the shifter string 76 contracts, the tension force on the shifter tool 60 is measured by a weight indicator at the surface. A predetermined amount of tension force is maintained on the shifter tool as acid is pumped. The tension force may be reduced to counteract the contracting length of shifter string 76. Thus, as shifter string 76 contracts, the tension on shifter tool 60 is reduced to insure that seals 61 remain in the seal bores and that acidizing mandrel 52 is adjacent ports 115.

If the sleeve valve is to remain open, the boss 119 is slipped past C-ring 122 and the shifter string continues to be pulled upward. The closing shifter 64 will pass the sleeve valve 114 in the upward direction since there are no upward facing square closers on the keys 350 of the closing shifter 64 to engage the upper engagement recess 120 or lower engagement recess 121 of the sleeve valve 114. The closing shifter is typically located one pipe length below the locator assembly. The opening shifter 62 and locator assembly 63 can then be moved upward to a separate stimulation zone where, through the same opening and locating operation, that zone may be acidized. The snagging feature described permits selective location of the locator assembly 63 and the sleeve valves within the housing 101.

If it becomes necessary to reverse the direction of the shifter tool 60 to dispose it downwardly into the housing 101, this may be accomplished without closing the sleeve valve 114 and without encountering the snagging condition which was created as the shifter tool 60 was moved upwardly with respect to the housing. FIG. 4 depicts the locator assembly 230 after having been unsnagged. Note that boss 119 is disposed above C-ring 122. Movement of the shifter tool 60 downwardly with respect to housing 101 will cause boss surface **119*b* to contact corner 122*a* of the C-ring 122 and slide C-ring 122 axially downward along the inside of housing 101 until it reaches annular expansion notch 112 and expands radially into the notch 112. Upon radial expansion outward into notch 112, the C-ring 122 will be moved outward from blocking boss 119 so that no significant snag will occur. In the typical case, the additional force needed to move the C-ring 122** into the expansion notch will only amount to approximately 100 pounds of additional downward force.

Following unsnagging under tension, the shifter string 76 may continue to be pulled upward in order to either continue acidizing in a different producing zone or to remove the shifter string from the tubing string 70. As the shifter string 76 is removed, the well control valve shifter 65 will pass and slide the sliding sleeve valve which activates flapper valve 75 and causes it to close.

Figure 6A:
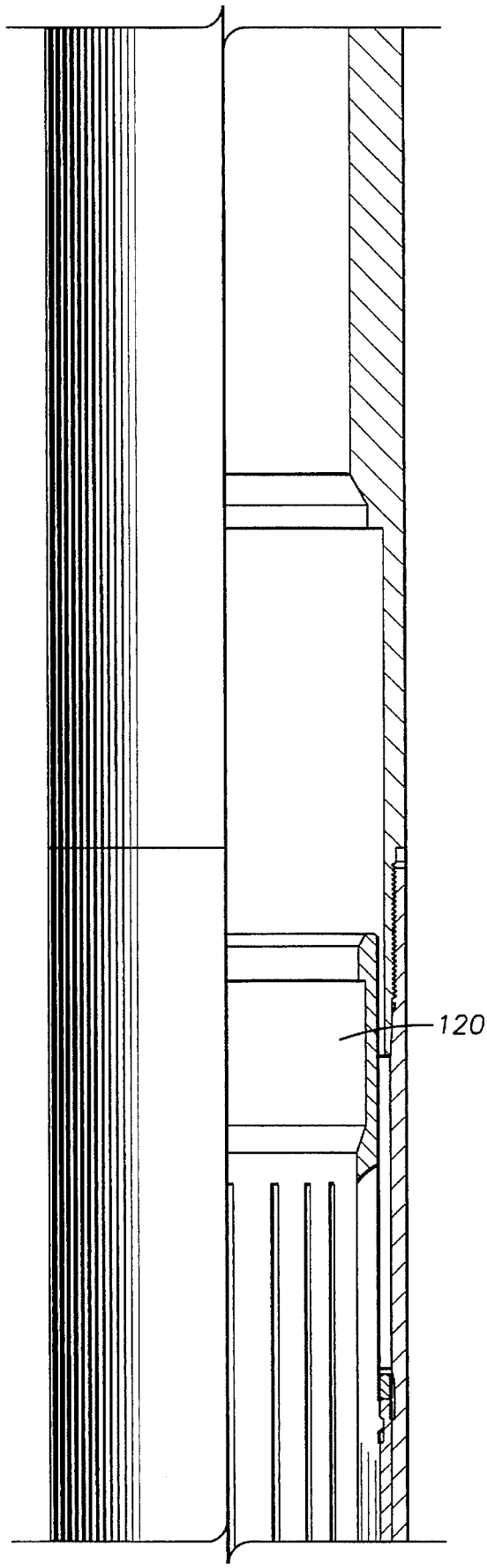
FIGS. 6A and 6B illustrate the sleeve valve assembly of FIG. 1 during closure by the closing shifter.
Figure 6B:
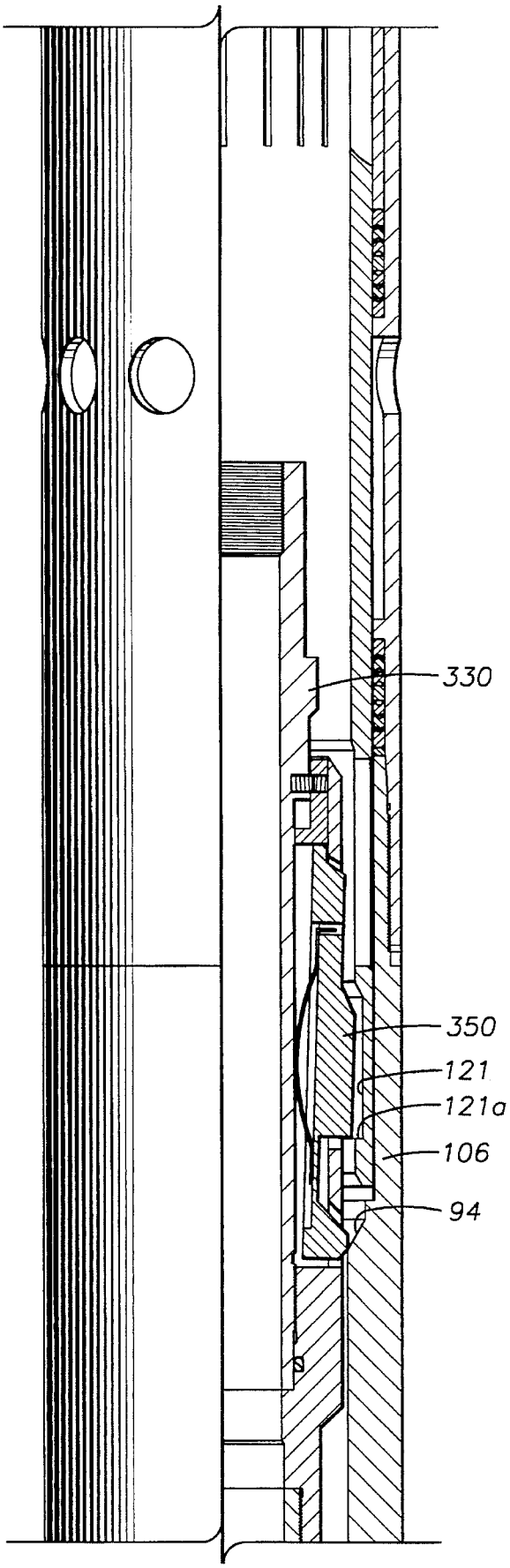

If, in an emergency, it becomes necessary to close the sleeve valve 114, the surface operator can accomplish this by drawing the shifter string 76 upward until the closing shifter 64 is disposed within the sleeve valve 114, adjacent engagement recess 121 and shoulder **121*a*. The closing shifter 64 may then be moved in a downward direction with respect to the housing 101 to close sleeve valve 114. The closing shifter 64 is also constructed and operates the same as the opening shifter 62 in most respects. As illustrated in FIGS. 6A and B, however, the components of the closing shifter 64 are reversed in direction. The keys 350 of closing shifter 64 are recieved within the lower engagement recess 121 rather than the upper engagement recess 120. In the manner described for opening shifter 62, the closing shifter 64 engages the sliding sleeve valve 114, shifts it toward its closed position and disengages from the sleeve valve 114 by key 350 camming against shoulder 94**.

If sleeve valve 114 is stuck so that it cannot be moved axially, emergency disengagement of the opening shifter 62, closing shifter 64 or locator assembly 63 may be performed. While an exemplary disengagement of the opening shifter 62 will be described, it is pointed out that disengagement of the locator assembly 63 and closing shifter 64 is similar in most respects. Disengagement of the keys 150 from sleeve valve 114 may be accomplished by pulling or jarring upwardly on the outer key mandrel 134 via the shifter string 76. The pulling or jarring will load the pin 140 in shear between the tool mandrel 137 and the annular sleeve 139. Upon shearing pins 140, skirt 98 is allowed to move upwardly with respect to the keys 150 and cam keys 150 inwardly due to the engagement of camming surfaces at 97. Upon shearing pins 140, skirt 98 is allowed to move upwardly with respect to keys 150 and cam keys 150 inwardly due to the engagement of camming surfaces at 97 and between **152*b* and 135*a*. Further upward pull on outer key mandrel 134 will then cause keys 150 to radially retract as the keys 150 are cammed inwardly at 97 as well as along surface 152*b* by surface 135*a*, respectively, thereby disengaging upper force bearing surfaces 153*a* and 120*a*. It is noted that the shear pin 140 should be a suitably strong member such that it will shear away only in response to a substantially higher degree of force than will be required to force boss 119 past C-ring 122**.

It is contemplated that the tool and assemblies thereof described herein have useful application for horizontal or deviated wells. It is thus noted that directional references such as upward/downward and upper/lower may be interchanged with inward/outward, and so forth.

While the invention has been described with respect to certain preferred embodiments, it should be apparent to those skilled in the art that it is not so limited. The sleeve valve and locator arrangement, as well as the operation of them described herein may used in perforation, fracturing or other operations. The closed and open positions of the sleeve valve, for example, may be reversed or the keys or other components of a shifter may be differently shaped. Various other modifications may be made without departing from the spirit and scope of the invention.

What is claimed is:

1. An apparatus in a borehole comprising:

a housing suspended within the borehole;

a slidable member disposed within said housing;

an expandable member disposed between said housing and said slidable member and having a contracted position at a first location and an expanded position at a second location;

an actuator member suspended within the borehole;

said actuator member engaging said slidable member and adapted to apply a tension force on said slidable member causing said slidable member to engage said expandable member in said contracted position at said first location;

said slidable member adapted to move past said expandable member upon said actuator member applying a predetermined tension force;

said actuator member adapted to engage said slidable member and apply a compression force to move said expandable member to said expanded position at said second location;

said slidable member adapted to move past said expandable member upon said actuator member applying a predetermined compression force; and said predetermined tension force being greater than said predetermined compression force.

2. The apparatus of claim 1 wherein said predetermined tension force is at least twice as great as said predetermined compression force.

3. The apparatus of claim 1 wherein said housing includes an inner surface having a recess at said second location, said inner surface maintaining said expandable member in said contracted position at said first location and said expandable member expanding into said recess in said expanded position at said second location.

4. The apparatus of claim 3 wherein said slidable member includes a stop member adapted to engage said expandable member at said first location and to move said expandable member to said second location.

5. The apparatus of claim 4 wherein said stop member radially contracts upon the application of said predetermined tension force such that the stop member may move past said expandable member in said contracted position.

6. The apparatus of claim 5 wherein said stop member includes a projecting surface disposed on a collet.

* * * * *